United States Patent [19]

Day

[11] Patent Number: 4,735,321

[45] Date of Patent: Apr. 5, 1988

[54] MOBILE EXTRA DISPLAY MODULE

[75] Inventor: Gerald G. Day, Marietta, Ga.

[73] Assignee: The Coca-Cola Company, Atlanta, Ga.

[21] Appl. No.: 859,110

[22] Filed: May 2, 1986

[51] Int. Cl.[4] ..... A47F 07/28

[52] U.S. Cl. ..... 206/597; 211/59.4; 211/74; 108/53.1; 108/56.1; 108/55.5; 108/55.1; 108/55.3; 100/2

[58] Field of Search ..... 206/386, 595, 596, 597, 206/598, 599, 600; 211/59.4, 74; 108/53.1, 56.1, 55.5, 55.1, 55.3; 100/2

[56] References Cited

U.S. PATENT DOCUMENTS

| | | | |
|---|---|---|---|
| 3,391,814 | 7/1968 | Box | 220/21 |
| 3,754,645 | 8/1973 | Kilroy | 206/65 B |
| 3,917,066 | 11/1975 | Cloyd | 206/386 |
| 3,982,654 | 9/1976 | Goltsegen | 220/21 |
| 3,995,736 | 12/1976 | Lawson et al. | 206/386 |
| 4,000,704 | 1/1977 | Griffin, Jr. | 206/599 X |
| 4,037,722 | 7/1977 | Bremer | 206/523 |
| 4,162,738 | 7/1979 | Wright | 220/21 |
| 4,263,855 | 4/1981 | Lawlor | 108/53.3 |
| 4,344,530 | 8/1982 | deLarosiere | 206/203 |
| 4,411,367 | 10/1983 | Bustos | 211/59.4 |
| 4,516,677 | 5/1985 | Rowland et al. | 206/394 |
| 4,567,981 | 2/1986 | Headon | 206/45.14 |
| 4,653,651 | 3/1987 | Flum | 108/53.1 |
| 4,667,823 | 5/1987 | Wolfe, Jr. et al. | 206/597 X |

*Primary Examiner*—William Price

[57] ABSTRACT

A mobile extra display module for storing, transporting, and displaying a quantity of containers, includes a plastic pallet base and a plurality of alternating layers of tier sheets and containers. The tier sheets have a top surface with an array of top recesses for receiving container bottoms, and a bottom surface with an array of bottom recesses for receiving container tops. The containers in each layer are in contact with adjacent containers. For storage and transportation purposes, the display module is made as a package unit including a rigid lid and a pair of straps extending around the unit, over the lid and under the base and being under a high force of about 100 pounds for holding the display module unit in a very strong and stable arrangement.

11 Claims, 5 Drawing Sheets

MOBILE EXTRA DISPLAY MODULE

BACKGROUND OF THE INVENTION

1. Field of the Invention

This invention relates to a packaging, distribution and display system for a quantity of containers, such as the well-known two liter plastic soft-drink bottles.

2. Description of the Prior Art

In retail stores, beverage bottles are displayed for easy access by customers on permanent shelves. The bottles are brought into the store in the corrugated boxes in which they are transported in the delivery truck. Alternatively, the bottles are stacked in an extra display stand at one end of a row of shelves with a thin sheet of material placed between each layer of bottles. Such extra displays suffer from numerous disadvantages including: the amount of labor required to arrange the display, the fact that the display cannot be moved, the unattractive appearance of the display, and the structural instability of the display stack. U.S. Pat. No. 4,567,981 shows a mobile extra display module.

SUMMARY OF THE INVENTION

The present invention comprises a mobile extra display system including a pallet base and a plurality of alternating layers of bottles and tier sheets. This display module is preferably automatically built in a bottling plant at the end of a bottling line, as a packaged display module unit for storage and/or transporting, and including a rigid lid and a plurality of straps extending vertically around the display module unit over the lid and under the base and tightly holding all of the bottles in-between the lid and the base. Such a packaged unit is preferably built with two such units on a square 36″×36″ wood pallet and strapped to the wood pallet for storage and stacking. Such units can be stacked three high in the warehouse. The display modules can then be transported to the retail store either as complete, packaged storage units, or the units can be disassembled at the warehouse for transporting as individual display modules. A first set of straps holds the packaged display module unit to its base, and a second, separate set of straps, perpendicular to the first set, is used when securing a pair of packaged display unit modules together on a wood pallet. In either event, after a packaged display module unit has been properly positioned in a retail store, the straps and the lid are removed. The lid, tier sheets and base are returned to the bottling operation for re-use.

It is an object of the present invention to provide an inexpensive, portable, attractive, safe and stable stack display system for containers.

It is a further object of the present invention to provide such a system that can be easily manufactured at the plant and that can be stacked two units wide and three pairs of units high in the plant.

It is another object of the present invention to provide an especially attractive mobile extra display module which also has improved handling, storage and safety features.

It is another object to provide a display module unit that can be tilted without breaking open.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENT

With reference now to the drawings, the Figures show a mobile extra display module 10 for containers 12, such as the typical, well-known, two liter PET beverage bottle, according to the present invention. The display module 10 includes a base 14, and a plurality of alternating layers of containers 12 and tier sheets 18.

Figure 4:
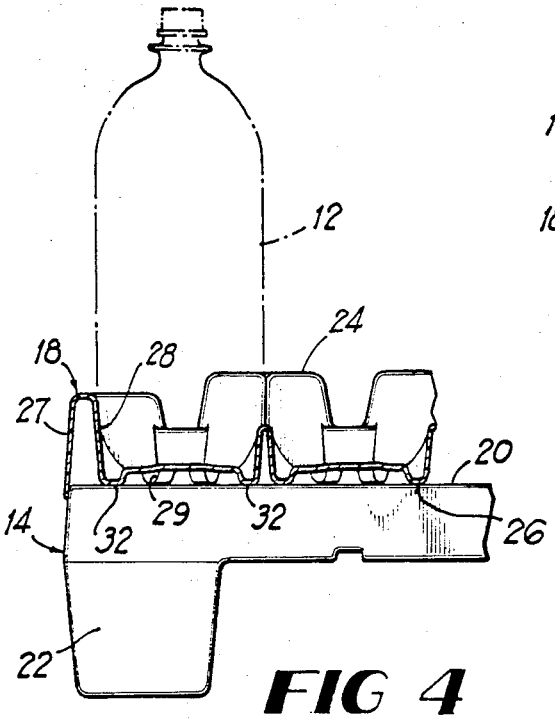
FIG. 4 is a partial cross-sectional view of the unit of FIG. 3 taken along line 4—4 of FIG. 3.
Figure 5:
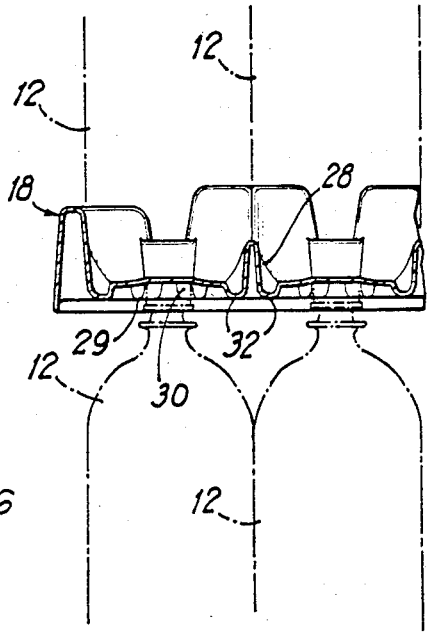
FIG. 5 is a partial cross-sectional view of the unit of FIG. 3 taken along line 5—5 of FIG. 3.
Figure 6:
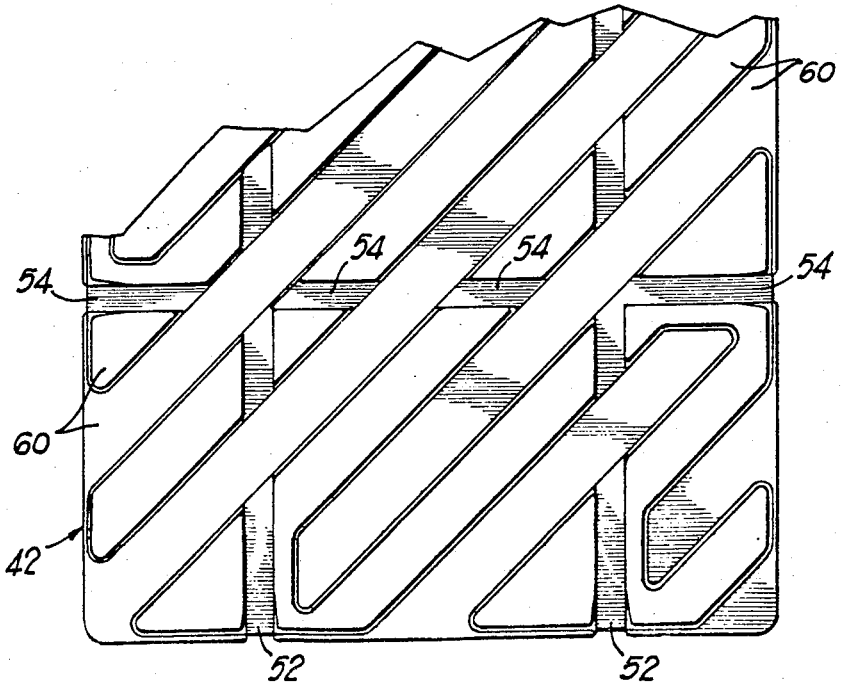
FIG. 6 is a partial top plan view of the lid used in FIG. 1.
Figure 7:
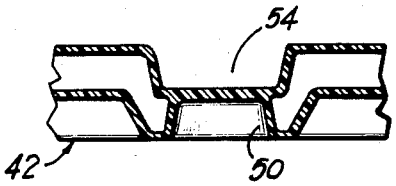
FIG. 7 is a partial cross-sectional view taken along line 7—7 of FIG. 1.

The base 14 includes a flat top surface 20 (see FIG. 4) and six legs 22 arranged so that the base 14 can be used as a pallet with a pallet jack.

The tier sheets 18 each have a top surface 24, a bottom surface 26, and a circumferential skirt 27 thereabout. The top surface 24 includes a rectangular array of top recesses 28 for receiving container bottoms. The bottom surface 26 includes a rectangular array of bottom recesses 30 for receiving container tops. The bottom surface 26 also includes a plurality of legs 32 around a border 29 surrounding each bottom recess 30. The legs 32 extend below the border 29, and have a distal end that is above the bottom edge of the skirt 27. The purpose of the legs is for use in spreading the weight of the display module on the base 14, by the lowermost tier sheet 18. The bottom recesses 30 are concentric to the top recesses 28. The top recesses 28 are preferably tangential to each adjacent recess so that the containers 12 are in contact. It is found that this provides additional strength and stability to the display module 10.

The base 14 is preferably slightly tapered along its side wall so that the lower edge of the bottom tier sheet fits tightly against the base to provide for both improved stability and appearance.

Figure 1:
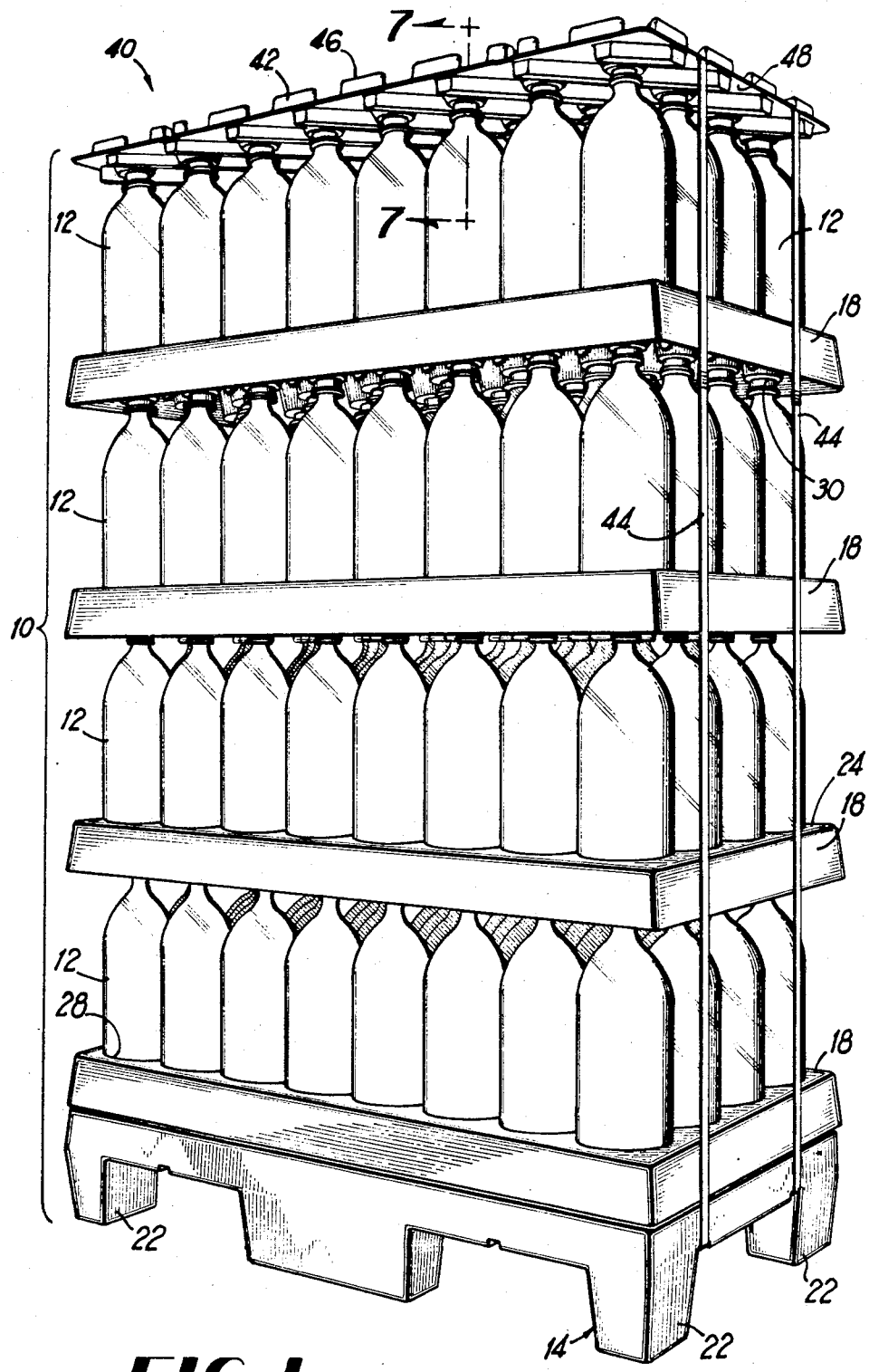
FIG. 1 is a perspective view of the packaged mobile extra display module unit of the present invention.
Figure 2:
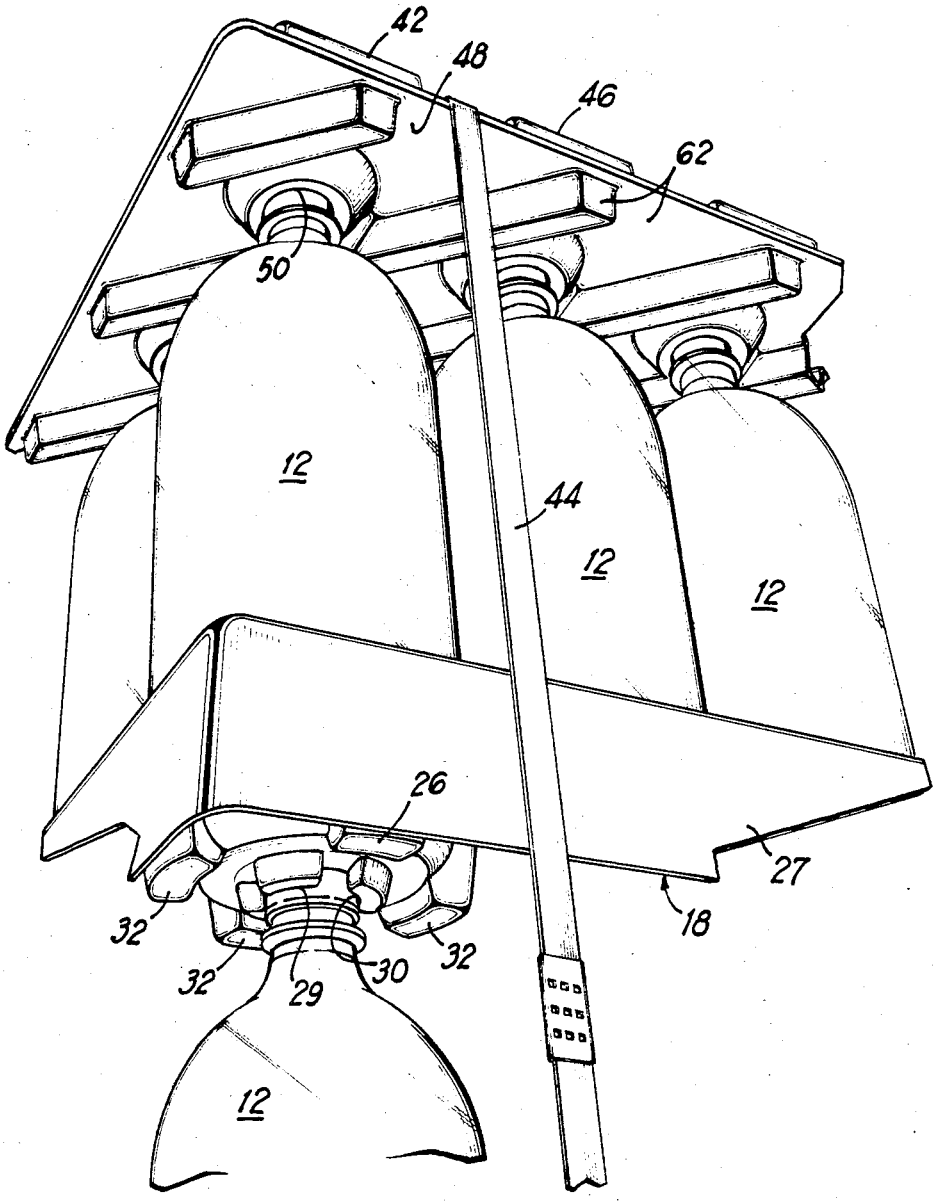
FIG. 2 is a fragmentary perspective view of the top portion of the display module unit FIG. 1.
Figure 3:
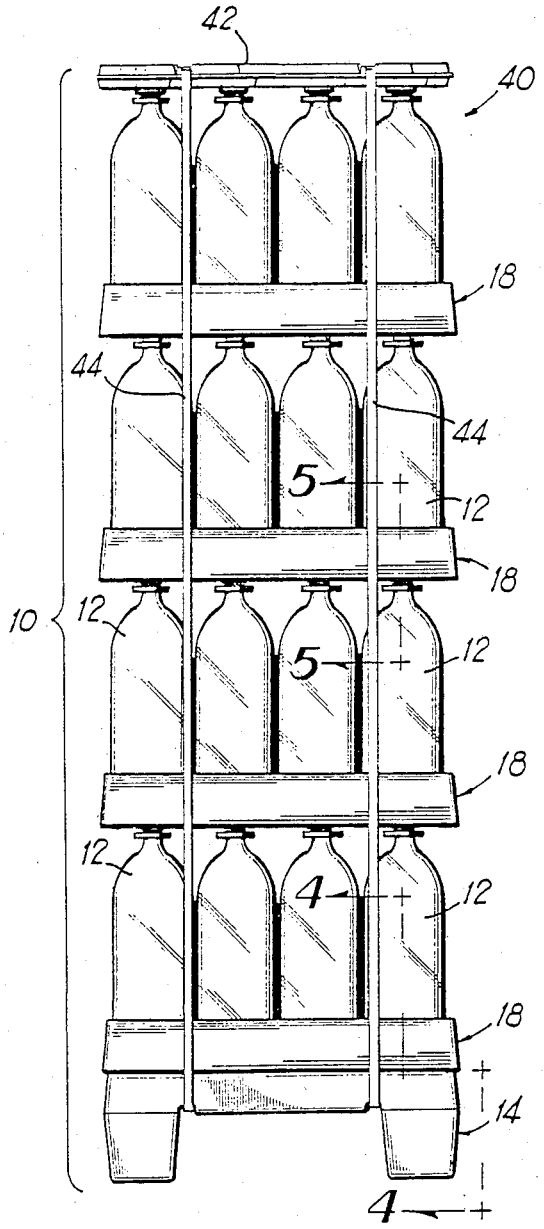
FIG. 3 is a side elevational view of the mobile extra display module unit of FIG. 1.

The display module 10 is shown in FIG. 1 as it is packaged as a display module unit 40 for storage and transportation. The display module unit 40 includes the display module 10 plus a lid 42 and straps 44. The lid is a rigid member having a top surface 46 and a bottom surface 48. The bottom surface 48 includes a rectangular array of bottom recesses for receiving container tops. The top surface 46 includes a first pair of parallel, strap-receiving grooves 52 extending longitudinally of the lid 42, and a second pair of parallel, strap-receiving grooves 54, extending perpendicular to the grooves 52.

The straps for a single unit 40 are placed around the unit 40 over the lid 42 and under the base 14, using the grooves 52. The straps are applied under sufficient force to hold the unit 40 as a very rigid stable arrangement. The straps 44 are preferably under a force of approximately 100 pounds. The straps 44 can be applied using standing metal strapping techniques. The straps 44 are preferably made of polyurethane.

Figure 8:
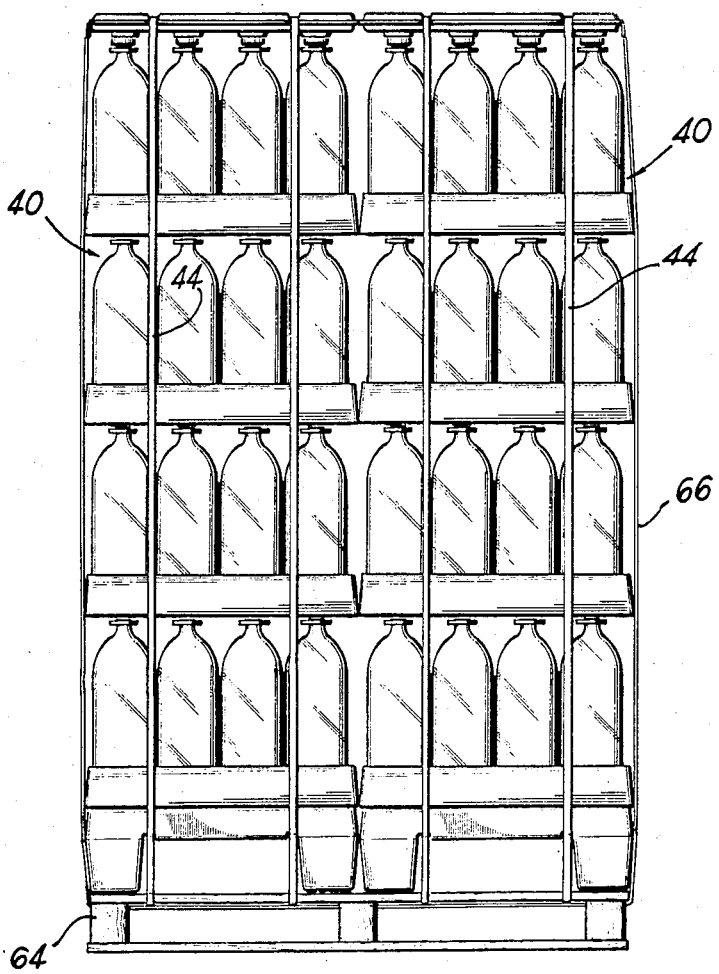
FIG. 8 is a side elevational view showing two display module units attached to a wood pallet.

For stacking the units 40 in a warehouse, two units 40 are placed on a single wood pallet 64 as shown in FIG. 8 and strapped thereto by straps 66 running over the lids, through the grooves 54, and running through the wood pallet. The double units can be stacked three high in a warehouse. The double units can be moved from a warehouse to a delivery trailer and transported to a retail store as such a double unit. Alternatively, the straps that hold the double unit together can be removed at the warehouse, along with the wooden pallet, and the single units 40 can be transported to the retail store. Once at the store, the unit 40 is transported to its desired location in the store, such as by use of a pallet lift. The straps 44 are then removed, along with the lid 42, leaving the attractive and stable display module 10.

The lid 42 must be rigid, so that it will not bend under the high force put on the straps 44. To that end, the lid 42 is preferably made of separate top and a bottom sheets, bonded together. The sheets are preferably made of plastic by blow molding. For added strength, each sheet has a plurality of alternating, parallel, ridges and grooves 60, with the ridges and grooves in the bottom sheet being perpendicular to those in the top sheet. The display module unit 40 can be tilted, such as during handling in the warehouse and during transporting on a slanted trailer floor or as the unit may be accidentally tilted during a quick stop, without breaking open, due to the rigid lid and tight force of the straps. This prevents bending of any of the tier sheets and its consequence of bottles coming loose.

The legs of the base 14 can have flat side surfaces or can have a vertical groove in each such side surface, for providing additional strength. The hollow inside of the base and its legs can be filled with a plastic foam for additional strength.

While the preferred embodiment of this invention has been described above in detail, it is to be understood that variations and modifications can be made therein without departing from the spirit and scope of the present invention as set forth in the appended claims.

For example, while the display module 10 is shown for use with 2-liter plastic beverage bottles, other containers can be used, such as cans, bottles, etc. A rectangular array of containers has been shown along with a rectangular tier sheet, base and lid; however, other shapes such as circular and square shapes, as well as irregular shapes can be used. While the lid and base are preferably made of two pieces bonded together, other numbers of pieces, such as one, three, etc., can be used. While plastic is preferred, other materials can be used. While two straps are shown in each direction, other numbers and directions can be used.

I claim:

1. A method for providing a packaged display module unit for stacking, storing, transporting and displaying a quantity of containers having tops and bottoms, comprising the steps of:

(a) providing a pallet base having a flat top surface and a plurality of pallet legs;

(b) positioning a one-piece tier sheet on said base, said tier sheet having a top surface, a bottom surface and a circumferential skirt surrounding said tier sheet, said top surface having an array of container-bottom receiving top recesses, and a bottom surface having both:

(i) an array of container-top receiving bottom recesses concentric with said top recesses, each of said bottom recesses being surrounded by an annular border, and (ii) a plurality of legs concentrically surrounding each of said bottom recesses and depending downwardly below said border and having a distal end located above a lowermost edge of said skirt;

(c) positioning a layer of containers on said tier sheet with their bottom ends in said top recesses;

(d) positioning a second one of said tier sheets on top of said layer of containers, with the top ends of said containers in said bottom recesses of said second tier sheet;

(e) repeating steps (c) and (d) to build up a stack of alternating layers of containers and tier sheets;

(f) positioning a rigid lid on top of the top layer of containers, said lid having a top surface and a bottom surface, said bottom surface having an array of container-top receiving bottom recesses similar to that of said tier sheets, and said lid top surface having a plurality of strap receiving grooves thereon; and (g) positioning a plurality of straps vertically around said display module unit and extending under said base and over said lid in said grooves of said lid, and tightening said straps with a force sufficient to hold said display module unit rigid, said lid having sufficient rigidity to remain flat and to resist bending under the force of said straps.

2. The method as recited in claim 1 wherein said lid top surface has a pair of straight, strap receiving first grooves extending longitudinally of said lid and a pair of straight, strap receiving second grooves extending perpendicular to said first grooves, and wherein said step of positioning said straps around said display module comprises positioning said straps in said first grooves.

3. The method as recited in claim 2 wherein said base is made of plastic and including the step of positioning a pair of said display module units on a single wood pallet and strapping said pair of display modules to said wood pallet with straps running through said second grooves.

4. The method as recited in claim 3 including the step of stacking a plurality of said pairs of strapped double units on top of each other.

5. The method as recited in claim 4 including the step of removing said second set of straps and said wooden pallet from said display module units and transporting said display module units to a retail store and positioning a display module unit in a retail store, and then removing said first set of straps and said lid from said display module unit.

6. The method as recited in claim 1 wherein said tightening step comprises tightening said straps with a force of approximately 100 pounds.

7. A display module unit for stacking, storing, transporting and displaying a quantity of containers having tops and bottoms, comprising:

(a) a pallet base having a plurality of legs;

(b) a plurality of layers of one-piece tier sheets alternating with a plurality of layers of containers positioned on said base with a tier sheet positioned in contact with said base;

(c) each of said tier sheets being identical and having a top surface, a bottom surface, and a circumferential skirt surrounding said tier sheet, said top surface having an array of container bottom receiving top recesses, and a bottom surface having both:

(i) an array of container-top receiving bottom recesses, concentric with said top recesses, each of said bottom recesses being surrounded by an annular border, and (ii) a plurality of legs concentrically surrounding each of said bottom recesses and depending downwardly below said border and having a distal end located above a lowermost edge of said skirt;

(d) a rigid lid on top of the top layer of containers, said lid having a top surface and a bottom surface, said bottom surface having an array of container-top receiving bottom recesses similar to that of said tier sheets, and said lid top surface having a plurality of strap receiving grooves therein; and (e) a plurality of straps extending vertically around said display module unit and extending under said base and over said lid in said grooves thereof, said straps having a tightening force thereon sufficient to hold said display module unit rigid, and said lid having sufficient rigidity to remain flat and resist bending under the force of said straps.

8. The apparatus as recited in claim 7 wherein said straps are under a force of about 100 pounds.

9. The apparatus as recited in claim 7 wherein said base is a plastic base.

10. The apparatus as recited in claim 7 wherein said lid top surface has a pair of straight, strap-receiving first grooves extending longitudinally of said lid and a pair of straight, strap-receiving second grooves extending perpendicular to said first grooves.

11. The apparatus as recited in claim 10 including a pair of said units on a wood pallet positioned underneath said pair of display module units and including a plurality of straps connecting the pair of display module units to said wood pallet and extending underneath said wood pallet and over said lid through said second grooves.

* * * * *